United States Patent [19]

Takasu et al.

[11] Patent Number: 4,693,951

[45] Date of Patent: Sep. 15, 1987

[54] IMAGE FORMING METHOD AND IMAGE BEARING MEMBER

[75] Inventors: Yoshio Takasu, Tama; Yoshihiro Oguchi; Kazuharu Katagiri, both of Yokohama, all of Japan

[73] Assignee: Canon Kabushiki Kaisha, Tokyo, Japan

[21] Appl. No.: 616,279

[22] Filed: Jun. 1, 1984

[51] Int. Cl.[4] ..... G03G 13/22; G03G 13/24

[52] U.S. Cl. ..... 430/31; 430/56; 430/139; 427/14.1; 346/74.2; 346/153.1; 346/160

[58] Field of Search ..... 430/31, 56, 139; 427/14.1; 346/153.1, 74.2, 160

[56] References Cited

U.S. PATENT DOCUMENTS

| | | | |
|---|---|---|---|
| 3,561,863 | 2/1971 | Brewster | 355/3 R |
| 3,816,117 | 6/1974 | Kankeiwen | 430/67 |
| 3,816,840 | 6/1974 | Kotz | 430/122 X |
| 3,890,040 | 6/1975 | Schmidlin | 355/16 |
| 3,909,258 | 9/1975 | Kotz | 430/122 |
| 4,298,669 | 11/1981 | Marushima et al. | 430/55 |
| 4,396,927 | 8/1983 | Amaya | 346/153.1 |
| 4,492,745 | 1/1985 | Mimura et al. | 430/56 X |

*Primary Examiner*—Roland E. Martin

*Attorney, Agent, or Firm*—Fitzpatrick, Cella, Harper & Scinto

[57] ABSTRACT

An image bearing member for forming a toner image on the surface thereof characterized in that said surface has a maximum surface roughness of 20 μm or less, and an average surface roughness satisfying the relation of $r \leqq 2d$ between the average surface roughness and a toner particle size, wherein r is the average surface roughness; and d is a mean particle size of the toner particles; a contact angle with water at least 70 degrees; or a pencil hardness of F or harder as measured according to the JIS test method K-5400; a process for forming image with said member, and an utility thereof.

7 Claims, 7 Drawing Figures

IMAGE FORMING METHOD AND IMAGE BEARING MEMBER

BACKGROUND OF THE INVENTION

1. Field of the Invention

This invention relates to an image display device for reproducing and displaying an electrical image information as computing output or reading output from a computer or an image reading device, an image information accumulated and memoried in a magnetic tape or microfilm as a soft copy in the form of a visible image, or an image display device to be attached as an image monitor, etc. to a machine related to image formation such as copying machine, office automation apparatus, etc.

More particularly, the present invention pertains to improvement of an image bearing member for a device which effects image display or image formation by forming a toner image as the display image corresponding to inputs of various information signals as mentioned above on the surface of an adequate image bearing member.

2. Description of the Prior Art

As the image display device known in the art, for example, CRT display devices and liquid crystal devices have generally been employed widely. These display devices, however, are not necessarily satisfactory in resolution, size of the display picture face or visibleness. For example, in view of the recent progress of office automation machines, the display picture face required for monitors for word processors, microfilm searching and optical disc memory is a highly precise stationary image, and therefore CRT or liquid crystal cannot be stated to be adequate due to flicker or dependence on vidual angle.

On the other hand, other than the aforesaid CRT display or liquid crystal display, for example, U.S. Pat. application Ser. No. 445,070 (Tamura et al, filed on Nov. 29, 1982) disclosed a method, in which a photoconductive layer is used as the image bearing member and a toner image is formed simultaneously with image exposure to make the toner image a display. Japanese Utility Model Laid-open Publication No. 55061/1982 discloses a method in which an electrostatic image is formed by scanning a pin electrode on a dielectric belt of image forming member and the toner image is obtained corresponding to the electrostatic image and exhibited as a display. Alternatively, there is also a method in which a toner of magnetic powder or magnetic gas is visualized and displayed on the surface of an image bearing member by a readily magnetizable stylus corresponding to the magnetizing signals.

In the display obtained according to such image forming methods, an image quality comparable to printing can be obtained. Particularly, since it is a stationary image display, as compared with the dynamic image display (the system in which image elements are displayed under lighted state by repeating lighting and non-lighting through utilization of the after image effect of eyes) such as CRT display or liquid crystal display, it can be made into a display which can be very easily viewed without fatigue of eyes.

Whereas, some problems are involved in a device of the system wherein the toner image obtained by the image forming method as described above is displayed. That is, because the same image member is used repeatedly, the toner or the colorant used therefor are gradually attached on the image display surface, whereby the non-image portion will markedly be stained. More specifically, displaying according to this system comprises the steps of forming a latent image on an image bearing member with the information signal in a time series signal such as light (e.g. laser beam), or voltage or current, and subsequently visualizing the latent image by developing with a toner. When the display is no longer necessary, via an extinguishing step, an image pattern is formed again according to the same steps on the same image bearing member surface, thus effecting display repeatedly. Accordingly, staining of the surface of the image bearing member damaged markedly the image quality, which was an obstacle in practical application of the display device according to this system. As another device according to a system employing similar steps for obtaining the image, there is a device in which a toner image is formed on an intermediate master such as those employed in electrophotographic copying, electrostatic printing, magnetic printing, etc., and transferred onto a plain paper to obtain a print image. The intermediate master to be used in these print devices, which is also used repeatedly, poses no problem even if the surface itself may be stained, provided that it has no effect on the transferred image. Thus, the performance required for such an intermediate master is essentially different from that required for the image bearing member to be used in the display device as described above. As still another problem in this kind of display device, the image density or sharpness will be changed depending on the use environment to be changed greatly image quality More specifically, since displaying according to this system comprises the cycle of toner image formation-displaying-extinction as disclosed above, the change in image quality depending on the environment has been an obstacle in practical application of the display device according to this system. As another device according to a system employing similar steps for obtaining the image, there is a device in which a toner image is formed on an intermediate master such as those employed in electrophotographic copying, electrostatic printing, magnetic printing, etc., and transferred onto a plain paper to obtain a print image as aforementioned. In these print devices, various controlling mechanisms for forming adequate image, such as means for toner supplement or heating for temperature maintenance, and further the transferred image can be finished uniformly as the print image by the fixing step. In contrast, in this kind of display device, there are limits to these controlling means and besides no fixing step can be conducted. Therefore, the image bearing member to be used in this kind of display device is required to have characteristics with less dependence on the environment as compared with the intermediate master in a printer device. As still another problem, during repetitive use of the same image bearing member, a large number of flaws are generated, whereby staining is increased by image defects or the toner embedded in the flaws to result in marked lowering in image quality. That is, since displaying according to this system comprises the cycle of toner image formation-displaying-extinction as disclosed above, staining of the display surface of the image bearing member by flaws or embedding of the toner in the flaws will damage markedly the image quality, and it was a great obstacle in practical application of the display device of this system.

SUMMARY OF THE INVENTION

An object of the present invention is to provide a highly precise and highly reliable image display device and also an image display device which has overcome the drawbacks as described above.

Another object of the present invention is to provide an improvement of an image bearing member to be applied for a device according to a system of forming a toner image and making this toner image a display, particularly an image bearing member having high stability, high durability, high humidity resistance, high scraping resistance and high staining resistance.

According to the present invention, there is to provide an image bearing member for forming a toner image on the surface thereof characterized in that said surface has a maximum surface roughness of 20 μm or less, and an average surface roughness satisfying the relation of $r \leqq 2d$ between the average surface roughness and a toner particle size, wherein r is the average surface roughness; and d is a mean particle size of the toner particles; a contact angle with water at least 70 degrees; or a pencil hardness of F or harder as measured according to the JIS test method K-5400, and an image forming method by using the same, which is also used in a cycle of toner image formation-displaying-extinction.

DETAILED DESCRIPTION OF THE EMBODIMENTS

The present invention concerns improveent of staining resistance, environment dependence, particularly humidity resistance and scraping resistance of the image bearing member to be used in an image display device as mentioned above. So far as staining is concerned, it can be improved by prevention of attachment of the toner which is the cause for generation of staining. Particularly, the present inventors have made investigations with an attention on the relationship between the surface roughness of the image bearing member and the toner particles, and found that generation of staining can be markedly alleviated, even when the cycle of toner image formation-display-extinction may be performed, by making the maximum surface roughness on the image bearing member not more than 20 μm and $r \leqq 2d$, wherein r and d are as defined above. Also, as for variation in image quality depending on the environment, the present inventors have investigated with an attention on the surface energy of the image bearing member as the cause for such variation. As a result, it has been found that the image quality variation due to environmental dependence can be markedly prevented by making the contact angle of the image bearing surface with water 70 degree or larger. Further, the present inventors have also studied about scraping resistance of the image bearing member, and found that staining generated by scraping can be markedly alleviated, even when the cycle of toner image formation-display-extinguishment may be performed, by making the hardness of the image bearing member a pencil hardness of F or harder, as measured according to the test method of JIS K-5400.

The specific features and the effects of the image bearing member of the present invention are to be described in detail below. As an example of the image display device utilizing toner image, a system employing a photoconductive layer as the image bearing member is shown in FIG. 1.

Figure 1:
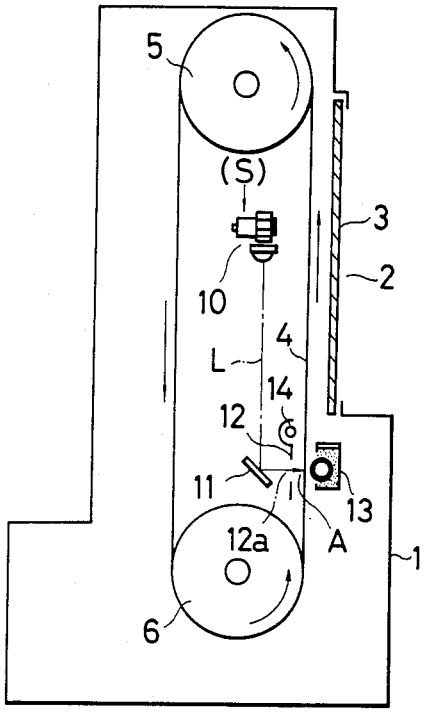
FIG. 1 is a schematic illustration of an example of a display device.

FIG. 1 is a sectional side elevational view, showing a mere schematic structure, of an example of the above display device, in which 1 is a vertical type armoring case of the device, 2 is a display image peeping window opened greatly on the front plate of the armoring case, which is generally provided with a transparent plate such as glass plate extending thereover.

Figure 2:
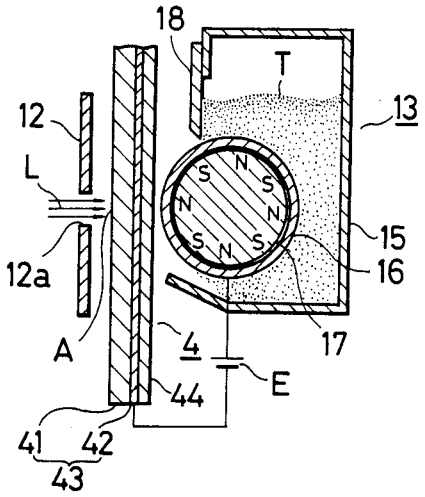
FIG. 2 is an enlarged sectional view of the developing section of the device shown in FIG. 1.

4 is an endless belt type photosensitive member (image bearing member, hereinafter abbreviated merely as belt) provided by extending between a driving pulley (or roller) 5 and a driven pulley (or roller) 6 provided laterally in parallel at the upper part and the lower part in the armoring case. The belt is constituted of, for example, as shown in FIG. 2, a transparent conductive substrate layer 43 formed by providing a metal or metal oxide (e.g. indium oxide, tin oxide, chromium oxide) layer 42 thinly by vapor deposition on the outer surface of a tough base sheet material 41 such as a synthetic resin sheet or film which is transparent and has high tnsile strength, and a photoconductive layer 44 laminated by coating or vapor deposition on its conductive layer surface 42, the outer peripheral surface of the belt being the photoconductive layer surface. And, the belt 4 is driven by rotation in the direction of the arrow by rotation of the driving pulley 5, and the outer surface of the belt 4 on the stretched side moves upwardly along the display image peeping window.

10 is an optical image exposing device of light beam scanning system provided within the space between the stretching side and the loosening side of the above rotating belt, and may comprise a semiconductor laser (gas laser) polygon mirror, f θ-lens, etc. And, it receives an electrical image element signal S in time series from an image reading device or a computer omitted in the drawing, and oscillates a laser beam L modulated in correspondence to the signal in the direction toward the driven pulley 6. The oscillated beam is deflected in the way by a mirror 11 toward the back face portion A of the stretching side belt nearer to the driven pulley 6, and scans and irradiates the belt back face portion A in the belt width direction. With the belt width direction scanning being as the primary scanning, while with the movement direction of the belt 4 as the secondary scanning, optical image exposure is successively applied on the back face of the belt 4.

13 is a developing device disposed on the front side of the belt corresponding to the belt back face portion A which receives the above laser beam scanning exposure, 14 is a lamp for light irradiation over the entire face disposed on the back face side of the stretching side belt and downstream of the exposed portion A with respect to the belt moving direction.

The developing device 13 shown in the drawing consists of a developer housing box 15, a non-magnetic rotary developing sleeve 16 made of stainless steel, aluminum, etc. provided laterally in the box 15, with approximately half peripheral surface on the left side being exposed from within the box to the outside, a magnet roller included by insertion into the sleeve 16, a blade 18 for applying the developer onto the sleeve outer surface and a developer T (conductive magnetic toner) housed in the box 15. The toner T in the vicinity of the rotary developing sleeve 16 is attracted by the magnetic field of the magnet roller 17 provided internally of the sleeve, held as the magnetic adsorbed layer on the outer peripheral surface of the sleeve to be rotated together with the sleeve, regulated in the way of its layer thickness to be made a regular layer, which regular layer surface of the toner in turn contacts and passes over the belt front portion corresponding to the exposed portion A on the belt back face through the rotation of the sleeve.

Between the conductive layer 42 on the belt 4 side and the developing sleeve 16, a direct current bias is applied and E shows a power source therefor.

And, the image display is effected by formation of a toner image corresponding to the exposed image through selective attachment of the conductive toner on the developing sleeve side onto the belt surface side, following the principle as described hereinafter, on initiation of the optical exposure on the exposed portion A on the back face side of the belt 4 under the state where the belt 4 and the developing device are driven. The belt surface on which the toner image is formed is positioned by rotation within the range of the image peeping window 2, where it stops once. By doing so, image display can be seen at the window portion 2. After elapse of I a certain period of time, or by the button operation to rerotate the belt, the belt 4 is set again on rotation, and the subsequent display image is migrated to the window portion 2, followed by once stopping and image display. By repetition of such procedures, the image can be successively displayed.

The toner image already displayed on the belt surface reaching again the developing device 13 by rotation of the belt after completion of image display is removed by the developing device through its developing and cleaning action to be recovered to the developing device side. On the belt surface from which the toner image has been removed, the toner image corresponding to the optical image exposed pattern on the exposed portion A is successively formed, and the toner image on the belt is migrated toward the display window portion 2 as the belt 4 is rotated.

The lamp 14 for whole surface irradiation is disposed for the purpose of uniformizing the electrical states in the respective portions within the photoconductive layer 14 of the belt 4 by irradiating light uniformly in the width direction on the back face side of the belt, on the front side of which is formed the toner image through the exposed portion A.

Figure 3:
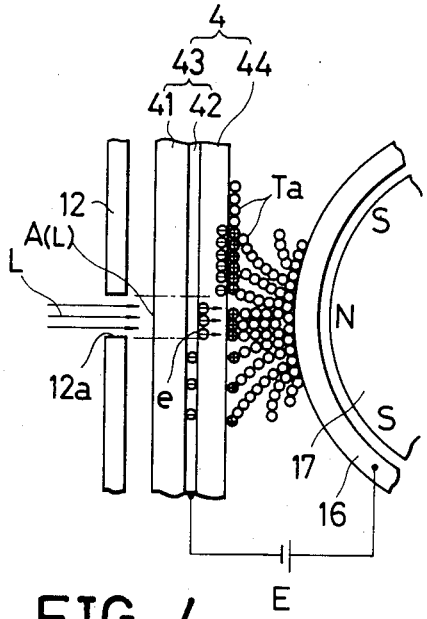
FIG. 3 is a schematic chart showing the image forming principle at the exposed light portion.
Figure 4:
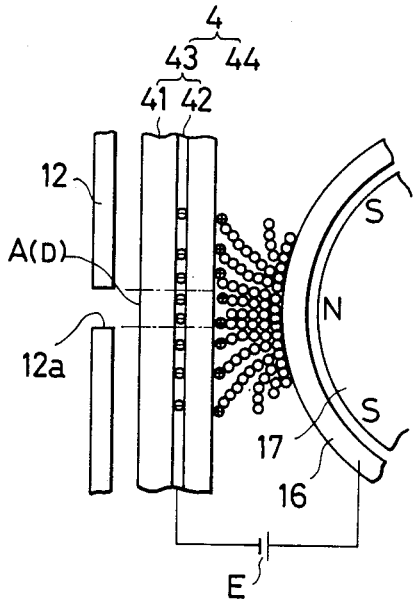
FIG. 4 is a schematic chart showing the image forming principle at the exposed dark portion.

The above formation of the toner image on the belt surface is effected without charging and simultaneously with optical image exposure, and its principle is described by referring to FIG. 3 and FIG. 4. Here, for convenience of explanation, it is supposed that the photoconductive layer 44 of the belt 4 is N type, and negative bias is applied on the conductive layer 42 and positive bias on the developing sleeve 16.

In the optical image exposed portion A on the belt back face, the light at the light exposed portion [A(L), FIG. 3] transmits through the transparent substrate layer 43 and enters the photoconductive layer 44. The photoconductive layer 44 receiving light incidence generates electron-hole pairs, of which electrons e are attracted by the negative bias of belt conductive layer and the positive bias of developing sleeve-positive to be migrated toward the front face side of the photoconductive layer 44. With the progress of such migration, positive charges as opposed to the electrons e as migrated above are induced in the conductive toner on the surface layer portion of the toner layer on the developing sleeve 16 side contacting and passing over the belt front surface portion corresponding to the optical image exposed portion A(L) on the belt back face. And, through the coulomb force between the electrons e and the positive charge-induced toner, the positive charge-induced toner is attached from the developing sleeve 16 side to the belt front face side (Ta). The positive charges of the attached toner Ta will soon disappear through neutralization of electrons e on the front face portion of the photoconductive layer 44.

On the other hand, in the exposed dark portion [A(D), FIG. 4], while the positive and negative charges are induced, respectively, in the conductive layer portion and in the surface layer of the conductive toner layer through the bias between the conductive layer 42 of the belt 4 and the capacitance between the conductive layer 42 and the developing sleeve 16 side, the coulomb forces acting between these are weak and therefore substantially no attachment of the toner occurs on the front face of the belt 4.

Thus, without charging treatment of the photoconductive layer 44 face of the belt 4, the toner can be attached (Ta) selectively only on the front face portion of the photoconductive layer corresponding to the exposed light portion of optical image exposure simultaneously with optical image exposure to form a toner image.

The toner image rotated to the developing device 13 portion after display receives scraping by the holding toner layer on the developing sleeve 16 side, whereby it can be easily removed and taken into the holding toner layer of the sleeve to be recovered, thus being repeatedly used for formation of the toner image.

The image display system as described above in which image display is effected by formation of a toner image on the image bearing surface utilizing a photoconductive member has various advantages. For example, it has better resolution than a CRT display device or a display utilizing liquid crystal. Since it is a stationary image without flickering and also smaller in angle dependency like a liquid crystal display, the image is easy to observe with small fatigue of eyes. The displayed image can give easily a hard copy, if necessary, by providing additionally a mechanism for transferring the toner image formed on the belt onto a copy paper. Particularly, the device as shown in the above embodiment, wherein the toner image is formed according to a system simultaneously with exposure without charging, and developing and cleaning functions are possessed by the same means, can be very simple in structure and therefore practically very useful.

As the optical image exposing device 10, other than the laser beam scanning system as described with respect to the above embodiment, recourse may be made to LED array device, liquid crystal, PLZT of various shutter arrays capable of transmitting white light, etc. An exposing device utilizing X-ray may also be available. In this case, the substrate layer 43 of the belt 4 may not be transmissive of visible light but X-ray transmissive. Furthermore, the image bearing member to be used in the present invention can also have a surface smooth layer (not shown in the drawings) on the photoconductive layer 44 as described above. The smooth surface layer can be formed by applying a liquid dispersion, obtained by dispersing a white pigment such as titanium dioxide, zinc oxide, tin oxide, etc. or a suitable white dye in an appropriate binder such as polymethyl methacrylate resin, polystyrene resin, phenolic resin, polyamide resin, etc., on the photoconductive layer 44. Particularly, for improvement of staining resistance, it is preferred to use polymethylmethacrylate resin, polystyrene resin, acrylic-modified silicone resin or polycarbonate resin. On the other hand, for prevention of fluctuation in image quality depending on the environment, it is preferred to use polystyrene resin, polymethylmethacrylate resin, acrylic-modified silicone resin, polycrabonate resin or polyacylate resin. Further, for improvement of scraping resistance on the image bearing member surface, it is preferred to use acrylic polyol resin, urethane-modified polybutadiene resin, saturated polyester resin, acrylic-modified silicone resin, alkyd-modified silicone resin, polyethersulfone resin, polymethylmethacrylate resin or styrenemethyl methacrylate copolymer resin.

The display device as described above is an embodiment wherein a photoconductive layer is used for the image bearing member. Otherwise, it is also similarly possible to apply as the signal input system other than light a method, in which an electrostatic image is provided in a dielectric layer by use of pin electrodes, followed by toner image formation, or a method in which a magnetic image is formed by use of a magnetic toner by inputting a current signal in readily magnetizable stylus.

In the image display devices using these toner images, the image quality tends to be lowered as the result of gradual staining of the image bearing member surface after repetitive use. A number of factors may be considered as the causes for generation of such staining. As one of such factors, the relationship between the surface roughness of the image bearing member and the particle size of the toner employed has been investigated. It has been found that, at least when the surface smoothness of the image bearing member has a certain value or more, staining resistance in terms of the number of repetitive use can be markedly prolonged. More specifically, the surface smoothness as measured by the roughness meter of a tracer method is required to be 20μ or less at its maximum and, its average roughness r to be $r \leqq 2d$ (where d is the mean particle size of the toner), for improvement of staining resistance.

An image bearing member having such a surface smoothness can be formed by polishing its surface by means of calendering rollers or gravity rollers or by controlling the dispersibility of the pigment dispersion, particle sizes of the pigment or the ratio of the pigment to binder for formation of the above-mentioned surface smooth layer so as to give a desired surface smoothness.

Also, under highly humid conditions, there tends to occur marked lowering of image quality, such as lowering in image density and appearance of unfocused image. While a number of factors may be conceivable as the causes for lowering image quality under humid conditions, especially one factor, namely the contact angle of the image bearing member with water has been investigated. As a result, it has been found that the above image quality will not be lowered, if at least the contact angle of the image bearing member with water has a certain value or higher. More specifically, it has been found necessary for prevention of image quality deterioration such as lowering in image density or formation of unfocused image that the contact angle as measured by the contact angle measuring device should be 70 degrees or higher.

In the image display devices using these toner images, there is a tendency during repetitive use that a large number of flaws will be generated on the image bearing member surface with increased staining due to image defects or the toner embedded in the flaws, whereby image quality will be markedly lowered. Among various factors causing such flaws on the image bearing member surface, one factor, namely the hardness of the image bearing member surface, has been particularly investigated. As a result, it has been found that lowering in image quality through flaws will not occur, provided at least that the image bearing member surface has a pencil hardness of a certain value or higher. More specifically, it has been found necessary for prevention of image defect or toner staining by generation of flaws that the pencil hardness as measured according to the JIS (Japanese Industrial Standard) test method K-5400 should be F or harder.

Figure 5:
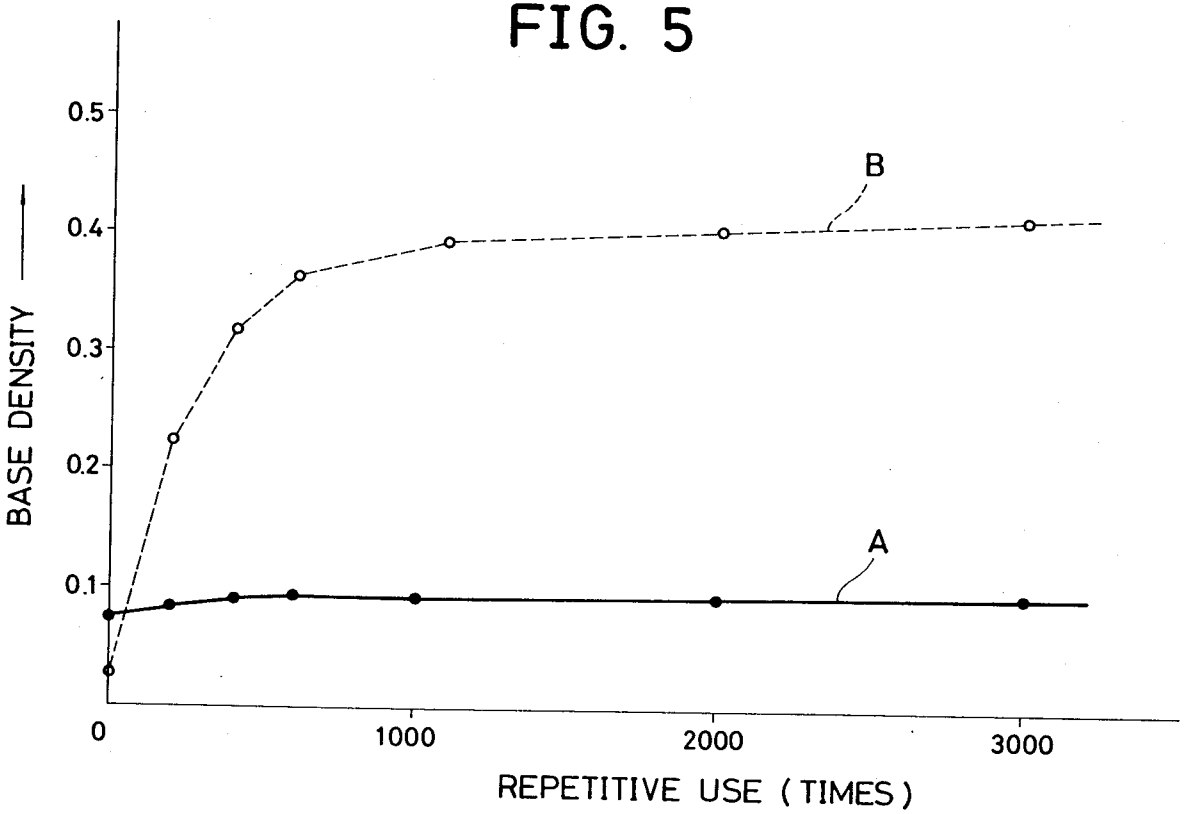
FIG. 5 is a graph showing the change in base density when the image bearing member is subjected to repetitive use.

While the details are described in Examples 1 to 5, the number of repetitive use and the extent of staining were investigated for two kinds of image bearing belts with different surface roughness by means of the display device as shown in FIG. 1. The average surface roughness of one of the belts prepared was (A) 2.1 μm, while that of the other (B) 13.5 μm. For each of the belts, image display was conducted repeatedly and the base density of the belt was measured by a reflective densiometer to give the result as shown in FIG. 5 (wherein the curve A shows the density change versus the number of repetitive use of the belt having the average surface roughtness of 2.1 μm, while the curve B versus the number of repetitive use of the belt having the average surface roughness of 13.5 μm). The toner used was a conductive magnetic toner prepared by melting and kneading 40 parts by weight of a methyl methacrylate resin and 60 parts by weight of magnetite, followed by crushing, and attaching fine powder of conductive carbon on the surface of the resultant particles in a hot air stream. The toner was subjected repeatedly to classification step, to prepar a toner having a very sharp distribution and a mean particle size of 5.8 μm.

As can be seen from FIG. 5, the base density on the belt (A) with the surface smoothness of 2.1 μm changed little versus the number of uses, but the belt (B) proved to be unsuitable for practical use with the base density being increased noticeably after the number of uses of about 400 times at the initial stage. Particularly of interest was the fact that the belt (B) was gradually smoothened on its surface as the belt was used repeatedly, until the average roughness on the surface became 12.5 μm after about repetitive use for 500 times, with the increase in base density becoming gradually gentle.

As speculated from this result, the toner image once prepared on a belt is already electrically neutralized as explained previously with respect to the principle for displaying image, and therefore the image is formed on the belt merely through contact such as Van der Waals force. At this time, if the magnetic field acts on the toner image with greater force than the contacting force in the extinction step, the toner can be returned again onto the developing sleeve to form a magnetic brush to be used in the subsequent image forming step, whereby there cannot be staining of the belt surface.

Whereas, when there is no smoothness on the belt surface, it may be considered that the contact area between the toner particles and the image bearing member is increased and no complete extinction can be effected to result in accumulation of staining. It can be judged that the belt surface will become smoothened with the increase of the attached toner, with staining being gradually reduced. Accordingly, by using at the initial stage a belt with a large surface roughness such as the belt (B) and measuring the surface roughness on reduction of the extent of staining, it is possible to delimit suitable degree of smoothness. As the result, it is desirable to satisfy the relation of $r \leqq 2d$, where r is the average surface roughness and d is the mean particle size of the toner. On the other hand, the maximum roughness of the belt has an effect on sharpness of the image, although partial staining may be disregarded. In view of image quality of high resolution and high gradation, the maximum roughness is required to be 20 μm or less.

As is evident from the foregoing, the present invention is based on the finding that the image bearing member is at least required to have a surface roughness as specified in claims for maintaining stably the image quality in a device for image display by formation of a toner image.

This result relates only to the toner and image bearing member surface and may be said to be effective for all the displaying devices irrespectively of the image forming system.

Also, although the details are described in Examples 6 to 11, dependency of image density and image quality on humidity was investigated for two kinds of image bearing belts with different contact angles by means of the display device as shown in FIG. 1. The contact angles of the belts prepared with water were (C) 87 degrees and (D) 68 degrees. The toner used was a conductive magnetic toner prepared by melting and kneading 40 parts by weight of a methyl methacrylate resin and 60 parts by weight of magnetite, followed by crushing, and attaching fine powder of conductive carbon on the surface of the resultant particles in a hot air stream. For each belt, the density in the solid image when humidity was changed was measured by a reflective densitometer and shown in FIG. 6 (wherein the curve C shows the image density change versus relative humidity of the belt having a contact angle of 87 degrees and the curve D that versus relative humidity of the belt having a contact angle of 68 degrees.

Figure 6:
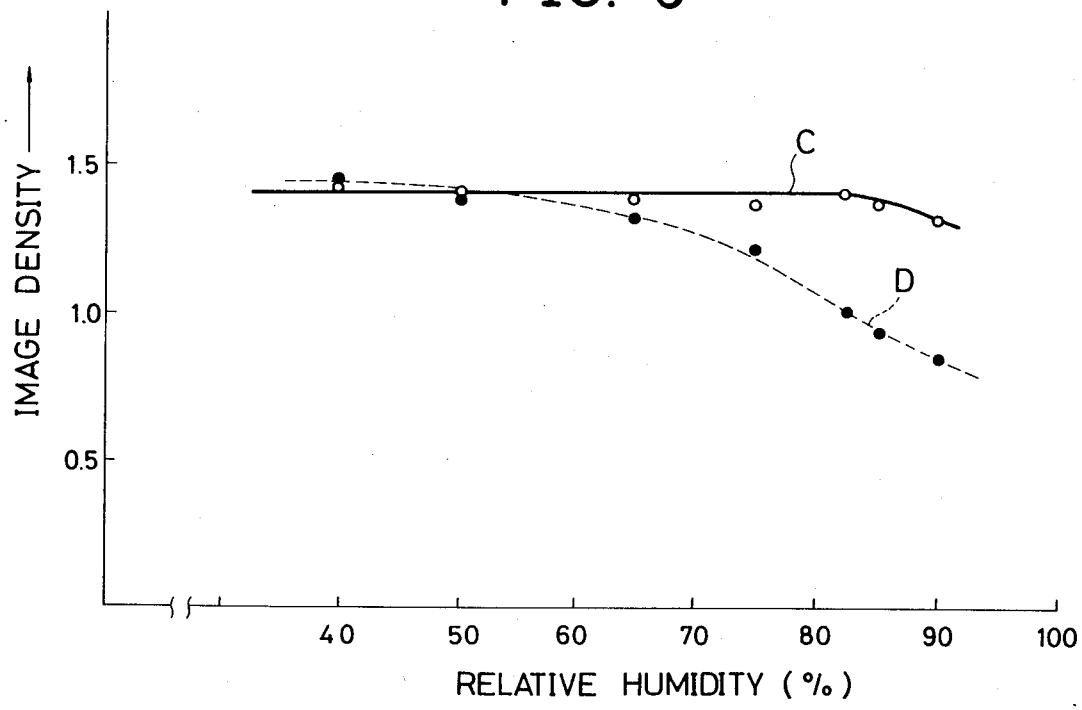
FIG. 6 is a graph showing the change in base density versus relative humidity.

As can be seen from FIG. 6, the image density on the belt (C) having a contact angle of 87 degrees was lowered little, while density lowering began on the belt having a contact angle of 68 degrees at around humidity in excess of 60%, and markedly lowered under high mumidity conditions. Also, unfocused image appeared at a humidity of 75% or higher to make the belt unsuitable for practical application.

As speculated from these results, the belt (C) is poor in wettability with a greater contact angle, that is lower in hydrophilic property, while the belt (D) is good in wettability with a smaller contact angle, that is high in hydrophilic property. Therefore, lowering in image quality under highly humid conditions may be considered to occur due to the change in developing characteristics depending on the extent of binding between the belt surface and moisture.

Also, the surface of a coated film is generally known to differ in wettability with water, namely contact angle, depending on the material employed, the solvent, drying conditions, etc. during preparation. Accordingly, it is possible to define suitable contact angles by preparing various kinds of samples with different contact angles and measuring the image densities under highly humid conditions. As the result, a contact angle of 70 degrees or higher was found to be necessary.

As is evident from the foregoing, the present invention is based on the finding that the image bearing member is at least required to have a contact angle with water as specified in claims for maintaining stably the image quality in a device for image display by formation of a toner image.

This result relates only to the toner and image bearing member surface and may be said to be effective for all the displaying devices irrespectively of the image forming system. Therefore, the Examples shown below are not limitative of the present invention.

Further, although the details are described in Examples 12 to 20, for two kinds of image bearing belts with different pencil hardness, the number of repetitive use and image quality were investigated by means of the device as shown in FIG. 1.

The belts prepared had a pencil hardness (M) 2H (corresponding to the curve M in FIG. 7) and (N) B (corresponding to the curve N in FIG. 5), respectively. The toner used was a conductive magnetic toner prepared by melting and kneading 40 parts by weight of a methyl methacrylate resin and 60 parts by weight of magnetite, followed by crushing, and attaching fine powder of conductive carbon on the surface of the resultant particles in a hot air stream.

Figure 7:
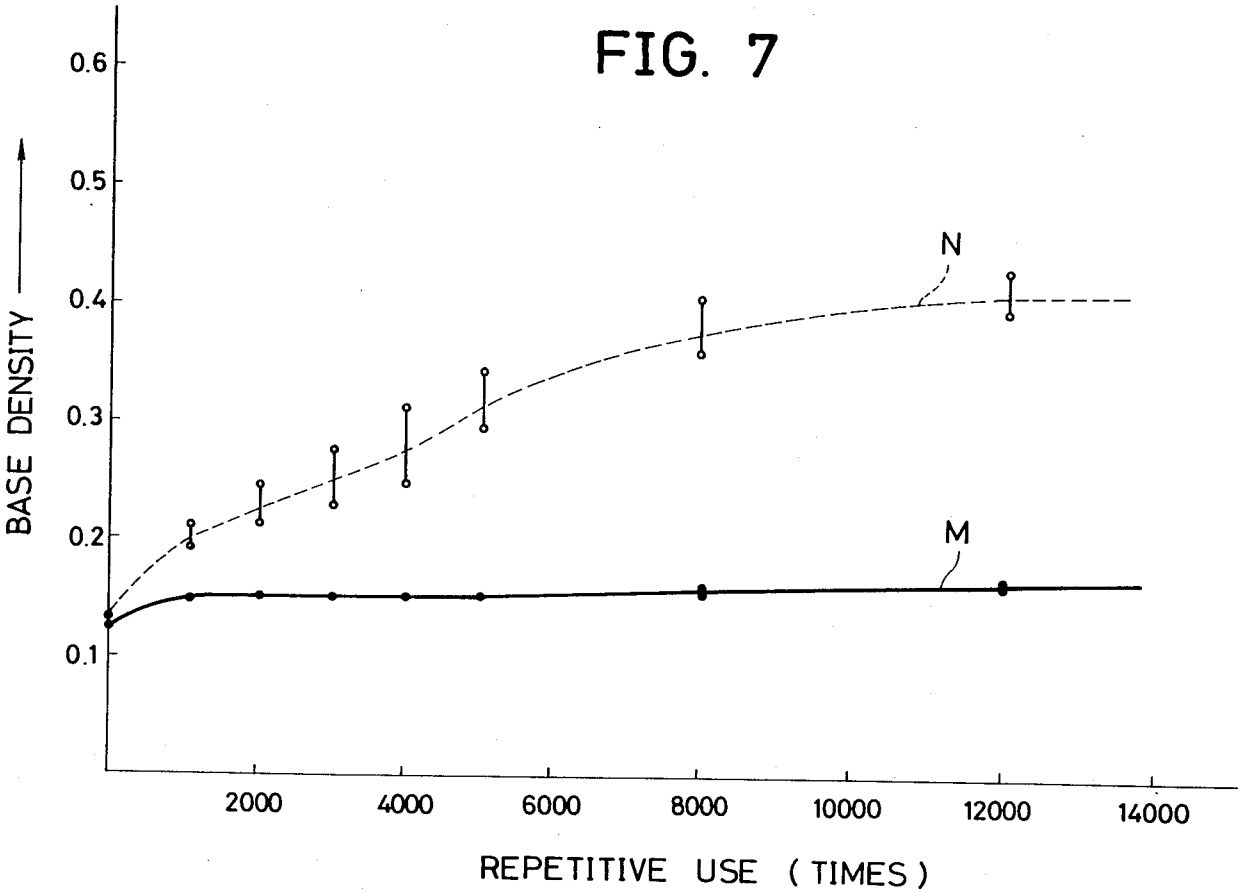
FIG. 7 is a graph showing the change in base density when the image bearing member is subjected to repetitive use.

For each belt, the change in base density was measured by a reflective densitometer, the maximum and minimum values were plotted on FIG. 7 and the average values were connected with a curve. Also, as observed visually, the belt (N) was found to be increased in staining as a whole at the initial stage of repetitive use, until coarseness of the image and thin black streaks in the conveying direction of the belt began to appear on about 2,000 times repeated uses, followed thereafter further by appearance of clear black streaks and tendency to be spread throughout the belt. In the belt (M), no such black streak was observed.

From FIG. 7 and the results by visual observation, it can clearly be seen that image quality was lowered little in the case of the belt (M) with a pencil hardness of H, while the belt (N) with a pencil hardness of B was markedly lowered in image quality and unsuitable for practical application.

As speculated from these results, the image bearing surface contacts and passes over the conductive magnetic toner at the developing device, as explained previously with respect to the principle for displaying image. The image bearing surface with a low pencil hardness such as the belt (N) is susceptible to generation of flaws through contact with the toner, and inextinguishable toner staining is also accumulated to result in increased base density, and deterioration of image such as coarseness of image and black streaks along its conveying direction, as is judged from these results.

Accordingly, it is possible to make comparison as to adequate hardness by preparing various kinds with different pencil hardness and examining the base density changes and generation of black streaks. As the result, a pencil hardness of at least F was found to be necessary.

As is evident from the foregoing, the present invention is based on the finding that the surface of the image bearing is at least required to have a pencil hardness of F or harder as specified in claims for maintaining stably the image quality in a device for image display by formation of a toner image.

This result relates only to the surface of image bearing member and toner development, and may be said to be effective for all the displaying devices irrespectively of the image forming system. Therefore, the Examples shown below are not limitative of the present invention.

EXAMPLE 1

According to the steps shown below, a photoconductive image bearing belt with good surface smoothness was prepared (see FIG. 2).

The image bearing member in this Example consisted of two layers, namely a photoconductive layer and a surface smoothening layer provided by coating on a transparent conductive base film. The transparent conductive base film employed was CELEC-KEC (trade name, produced by Dicel Kagaku Kogyo K. K., Japan). The coating solution of photoconductive layer and the coating solution of the surface smoothening layer were prepared as described below.

(1) Coating solution of photoconductive layer:

A dispersion of 100 parts by weight of CdS powder doped with Cu and In having a sensitivity to a semiconductor laser (820 nm) and 7 parts by weight of a polybutylmethacrylate with an average molecular weight of 10,000 in methyl ethyl ketone was kneaded on roll mill to provide a coating solution.

(2) Coating solution of surface smoothening layer:

To 60 parts by weight of $Ti0_2$ pigment, 10 parts by weight of a polymethylmethacrylate resin with an average molecular weight of 30,000 was added toluene to prepare a solution with a solid content of 15% by weight. This solution was dispersed by means of a sandmill dispersing machine (2000 rpm) for 30 hours to prepare a coating solution.

The $TiO_2$ powder was added for the purpose of increasing the whiteness of the image display surface and controlling the electric resistance of the surface layer.

Using the thus prepared coating solutions, first a photoconductive layer was applied to a dried film thickness of 70 μm on the aforesaid transparent conductive base film, then the surface smoothening layer to a dried film thickness of 20 μm each by means of a roll coater, to obtain an image bearing member.

The surface roughness of the image bearing member as measured by a universal configuration measuring instrument "Model Se-3C" produced by Kosaka Kenkyusho K. K., which is a tracer method roughness meter, was 2.1 μm as the average roughness and 5.5 μm as the maximum roughness (measurement was conducted in the same manner in other Examples).

Said belt was suspended and driven in the image displaying device as shown in FIG. 1 and the image display was repeated according to the procedure as described above. The toner particles employed had a mean particle size of 5.8 μm as measured by a toner particle size measuring device Coulter Counter Model $T_{AII}$ (Coulter Electronics Inc.) (measurement was conducted in the same manner in other Examples).

The image bearing member gave a clear image display without base staining for the repetitive display as shown in FIG. 5, graph (A).

COMPARATIVE EXAMPLE 1

An image bearing member was prepared according to the same procedure as in Example 1, except for using the solution prepared by dispersing the coating solution of surface smoothening layer prepared in Example 1 by means of a ball mill in place of the sandmill dispersing machine.

The image display surface had an average roughness of 13.5 μm and a maximum roughness of 18.0 μm.

The base staining in repetitive display on this belt was not desirable as shown in the graph (B) in FIG. 5.

EXAMPLES 2–4

Image bearing belts were prepared according to the same procedure as in Example 1, except the polymethylmethacrylate used as the binder resin for the surface smoothening layer in Example 1 was replaced with (1) polystyrene, (2) acrylic-modified silicone, and (3) polycarbonate, respectively.

The characteristics employing the respective surface smoothening layers are shown in the Table 1

TABLE 1

| | Resin | Average roughness | Maximum roughness | Increase of density after 5000 times' repetition (increased relfective density |
|---|---|---|---|---|
| Example 2 | Polystyrene | 3.4 μm | 6.0 μm | 0.04 |
| Example 3 | Acrylic-modified silicone | 1.1 | 3.2 | No change |
| Example 4 | Polycarbonate | 2.5 | 4.8 | 0.01 |

As can be seen from the above results, due to good smoothness of the surface, the members were found to be excellent in durability.

For comparison, when these resins were employed and coated in solutions as prepared according to the method of Comparative Example 1, the average surface roughness was 12 μm or more in each case, and the base density was increased markedly with repetitive number of display, thus giving no favorable result.

As can be judged from these Examples, in the device of the present invention, a certain level of surface roughness was required to be satisfied, not depending on the material for the surface smoothening layer.

Further, when a toner with an average particle size of 8.2 μm was employed, staining was observed to be markedly reduced, although its extent differing more or less, even with the use of an image bearing member having a surface roughness of 15 μm.

EXAMPLE 5

An image bearing belt was prepared by coating a magnetic tape having a $CrO_2$ thin film provided on a polyester film with the surface smoothening layer shown in Example 1 to a dried film thickness of 10 μm.

The image bearing belt had a surface roughness similar to that of Example 1.

The image forming steps by use of said belt were constituted similarly as shown in FIG. 1, but the magnetic latent image was formed by inputting a pattern signal of bar cord type into the magnetic head equipped before the developing station A in place of laser scanner. Also, in the developing device shown in FIG. 2, the fixed magnetic roll included within the rotary sleeve was not capable of magnetizing the developing portion. This was intended for not disturbing the magnetic latent image. The toner image prepared by means of this device had a contrast which could sufficiently be read with an OCR head. The extinguishing step was performed by thermally quenching the back face of the image bearing belt. In this constitution, the image bearing belt gave constantly stable OCR reading signals in repetitive formation of images.

EXAMPLE 6

According to the steps shown below, a photoconductive image bearing belt was prepared (see FIG. 2).

The image bearing member in this Example consisted of two layers, namely a photoconductive layer and a surface layer provided by coating on a transparent conductive base film. The transparent conductive base film employed was CELEC-KEC (trade name, produced by Dicel Kagaku Kogyo K. K.). The coating solution of photoconductive layer and the coating solution of the surface layer were prepared as described below.

(1) Coating solution of photoconductive layer:

A dispersion of 100 parts by weight of CdS powder doped with Cu and In having a sensitivity to a semiconductor laser (820 nm) and 7 parts by weight of a polybutylmethacylate with an average molecular weight of 10,000 in methyl ethyl ketone was kneaded on roll mill to provide a coating solution.

(2) Coating solution of surface layer:

To 60 parts by weight of $TiO_2$ pigment, 10 parts by weight of a polystyrene (Eskelene MS-200, produced by Shinnippon Seitetsu Kagaku Kogyo K. K., Japan) was added toluene to prepare a solution with a solid content of 30% by weight. This solution was dispersed by means of a sandmill dispersing machine (2000 rpm) for 10 hours to prepare a coating solution.

The $TiO_2$ powder was added for the purpose of increasing the whiteness of the image display surface and controlling the electric resistance of the surface layer.

Using the thus prepared coating solutions, first a photoconductive layer was applied to a dried film thickness of 70 μm on the aforesaid transparent conductive base film, then the surface smoothening layer to a dried film thickness of 10 μm, each by means of a roll coater, to obtain an image bearing member.

The contact angle of the image bearing member with water was measured by a contact angle measuring instrument, Kyowa Tracer Method Machine CA-DS type, produced by Kyowa Kagaku K. K. at 23° C., under 50% of relative humidity (measurement was conducted in the same manner in other Examples). The contact angle was 87 degrees.

Said belt was suspended and driven in the image displaying device as shown in FIG. 1 and the humidity characteristic of image density was measured according to the method as described above. The toner particles employed were prepared according to the procedure as described above.

The image bearing member gave a stable image even under highly humid conditions as shown in FIG. 6(C).

COMPARATIVE EXAMPLE 2

An image bearing member was prepared according to the same procedure as in Example 6, except for preparing the coating solution of the surface layer with the use of triamyl acetate in place of toluene. The contact angle of this image bearing belt with water was 68 degrees.

The dependence of the image density on humidity was examined with this belt to give no desirable result, as shown in FIG. 6 (D).

EXAMPLES 7–10

Image bearing belts were prepared according to the same procedure as in Example 6, except that the polystyrene used as the binder resin for the surface layer in Example 6 was replaced with a polymethylmethacrylate (Derpet LP-1, produced by Asahi Kasei Kogyo K. K., Japan)-Example 7, an acrylic modified silicone (KR-3093, produced by Shinetsu Kagaku K. K.)-Example 8, a polycarbonate (Panlite, produced by Teijin Kasei K. K., Japan)-Example 9, and a polyallylate (U-100, produced by Unitica K. K., Japan)-Example 10, respectively.

The characteristics employing the respective surface layers are shown in the Table below.

TABLE 2

| | Resin | Contact angle (degree) | Image density at humidity 60% | Image density at humidity 85% |
|---|---|---|---|---|
| Example 7 | Polymethylmethacrylate (Derpet LP-1; Asahi Kasei Kogyo K.K. Japan) | 71 | 1.48 | 1.28 |
| Example 8 | Acrylic-modified silicone (KR-3093; Shinetsu Kagaku Kogyo K.K., Japan) | 102 | 1.40 | 1.40 |
| Example 9 | Polycarbonate (Panlite-1250; Teijin K.K., Japan) | 85 | 1.42 | 1.38 |
| Example 10 | Polyallylate (U-100 Unitica K.K., Japan) | 79 | 1.38 | 1.35 |

COMPARATIVE EXAMPLE 3

On the photoconductive layer prepared in Example 6, a surface layer with a dried film thickness of 5 μm was formed with the use of a surface coating solution prepared according to the procedure shown below.

Surface coating solution:

A mixture of 40 parts by weight of $Ti0_2$ pigment and 20 parts by weight of a copolymer nylon (CM-4000, produced by Toray K. K.) was dissolved in ethyl alcohol to a solid content of 20% by weight. The solution was dispersed in a ball mill for 5 hours to prepare a coating solution.

The image bearing belt obtained has a contact angle with water of 68 degree. The image densities at relative humidity 60%, 85% were underiably 1.35, 0.58, respectively.

EXAMPLE 11

An image bearing member was prepared by coating a magnetic tape having a $CrO_2$ thin film provided on a polyester film with the surface smoothening layer shown in Example 6 to a dried film thickness of 10 μm.

The image bearing belt had a surface contact angle similar to that of Example 6.

The image forming steps by use of said belt were constituted similarly as shown in FIG. 1, but the magnetic latent image was formed by inputting a pattern signal of bar cord type into the magnetic head equipped before the developing station A in place of laser scanner. Also, in the developing device shown in FIG. 2, the fixed magnetic roll included within the rotary sleeve was not capable of magnetizing the developing portion. This was intended for not disturbing the magnetic latent image. The toner image prepared by means of this device had a contrast which could sufficiently be read with an OCR head. The extinguishing step was performed by thermally quenching the back face of the image bearing belt. In this constitution, the image bearing belt gave constantly stable OCR reading signals in repetitive formation of images.

EXAMPLE 12

According to the steps shown below, a photoconductive image bearing belt was prepared (see FIG. 2).

The image bearing belt in this Example consisted of two layers, namely a photoconductive layer and a surface layer provided by coating on a transparent conductive base film. The transparent conductive base film employed was CELEC-KEC (trade name, produced by Dicel Kagaku K. K., Japan). The coating solution of photoconductive layer and the coating solution of the surface layer were prepared as described below.

(1) Coating solution of photoconductive layer:

A dispersion of 100 parts by weight of CdS powder doped with Cu and In having a sensitivity to a semiconductor laser (820 nm) and 7 parts by weight of a polybutylmethacrylate with an average molecular weight of 10,000 in methyl ethyl ketone was kneaded on roll mill to provide a coating solution.

(2) Coating solution of surface layer:

To 30 parts by weight of $TiO_2$ pigment and 40 parts by weight of an acrylic polyol (Hitaloid 3340, produced by Hitachi Kasci Kogyo K. K., Japan) was added xylene to prepare a solution with a solid content of 30% by weight. This solution was dispersed by means of a sandmill dispersing machine (2000 rpm) for 20 hours. To this solution were added 6 parts by weight of a isocyanate prepolymer (Takenate D-110N, produced by Takeda Yakuhin Kogyo K. K., Japan) to prepare a coating solution.

The $TiO_2$ powder was added for the purpose of increasing the whiteness of the image display surface and controlling the electric resistance of the surface layer.

Using the thus prepared coating solutions, first a photoconductive layer was applied to a dried film thickness of 70 μm on the aforesaid transparent conductive base film, then the surface layer to a dried film thickness of 15 μm, each by means of a roll coater, to obtain an image bearing member.

The pencil hardness of the image bearing member was measured according to the JIS test method K-5400 (measurement was conducted in the same manner in the following Examples). The pencil hardness was 2 H.

Said belt was suspended and driven in the image displaying device as shown in FIG. 1 and the image display was repeated according to the procedure as described above. The toner particles employed were prepared according to the procedure as already described.

The image bearing member exhibited no lowering in image quality in repetitive display as shown in FIG. 7 (M).

COMPARATIVE EXAMPLE 4

On the photoconductive layer prepared in EXAMPLE 12, a surface layer with a dried film thickness of 5 μm was formed with the use of a surface layer coating solution prepared according to the procedure shown below.

Surface layer coating solution:

A mixture of 40 parts by weight of $TiO_2$ pigment and 30 parts by weight of a copolymer nylon (CM-8000, produced by Toray K. K., Japan) was dissolved in ethyl alcohol to a solid content of 20% by weight. The solution was dispersed in a ball mill for 5 hours to prepare a coating solution.

The image bearing belt obtained had a pencil hardness of B. The base density on the belt in repetitive use was undesirable as shown in FIG. 7 (N).

EXAMPLE 13

On the photoconductive layer prepared in Example 12, a surface layer with a dried film thickness of 15 μm was formed with the use of a surface layer coating solution prepared according to the procedure shown below.

Surface layer coating solution:

A mixture of 40 parts by weight of $TiO_2$ pigment and 30 parts by weight of a urethane-modified polybutadiene resin (TP-1001, produced by Nippon Soda K. K., Japan) was dissolved in butylacetate to a solid content of 35% by weight. The solution was dispersed by means of a sandmill dispersing machine for 5 hours to prepare a coating solution.

The image bearing belt obtained had a pencil hardness of F. The changes in base density and image quality in repetitive use were observed according to the same procedure as in Example 12. Then change in base density after repetition for 5,000 times was 0.05, without any lowering in image quality such as black streak being observed.

EXAMPLES 14–19

On the photoconductive layer as prepared in Example 12, the surface layers were formed in the same manner as in Example 13 except for using the resins and the solvents as shown in Table 3 in place of the urethane-modified polybutadiene and butyl acetate, respectively. The pencil hardness and the change in base density in repetitive use for each belt are shown in Table 3.

TABLE 3

| | Resin | Solvent | Pencil hardness | After 5000 repetitions | |
|---|---|---|---|---|---|
| | | | | Increase of base density | Generation of black streak |
| Example 14 | Saturated polyester resin (Byron-200; Toyo Boseki K.K., Japan) | Toluene | H | 0.04 | none |
| Example 15 | Acrylic-modified silicone (KR-3093; Shinetsu Kagaku | Toluene | 2H | 0.02 | none |

TABLE 3-continued

| | Resin | Solvent | Pencil hardness | After 5000 repetitions: Increase of base density | After 5000 repetitions: Generation of black streak |
|---|---|---|---|---|---|
| | Kogyo K.K., Japan) | | | | |
| Example 16 | Alkyd-modified silicone (KR-3093; Shinetsu Kagaku Kogyo K.K., Japan) | Toluene | H | 0.02 | none |
| Example 17 | Polyethersulfone (200P; Sumitomo Kagaku K.K., Japan) | Dimethyl-formamide/ Cyclohexanone/ methyl ethyl ketone | F | 0.06 | none |
| Example 18 | Polymethyl methacrylate (Derpet LP-1; Asahi Kasei Kogyo K.K., Japan) | Methyl ethyl ketone | 2H | 0.02 | none |
| Example 19 | Styrene-methyl methacrylate copolymer (Emethylene MS-200 Shinnippon Seitetsu Kagaku Kogyo K.K., Japan) | Methyl ethyl ketone | F | 0.04 | none |

COMPARATIVE EXAMPLES 5-6

On the photoconductive layer as prepared in Example 12, the surface layers were formed in the same manner as in Example 13 except for using the resins and the solvents as shown in Table 4 in place of the urethane-modified polybutadiene and butyl acetate, respectively. The pencil hardness and the change in base density in repetitive use for each belt are shown in Table 4.

TABLE 4

| | Resin | Solvent | Pencil hardness | After 5000 repetitions: Increase of base density | After 5000 repetitions: Generation of black streak |
|---|---|---|---|---|---|
| Comparative Example 5 | Polyester resin (Ester Resin 30; Toyo Boseki K.K., Japan) | Toluene | HB | 0.13 | 0.13 |
| Comparative Example 6 | Boil oil modified polybutadiene resin (GQ-1000; Nippon Soda K.K., Japan) | Xylene | B | 0.16 | 0.16 |

EXAMPLE 20

An image bearing belt was prepared by coating a magnetic tape having a $CrO_2$ film provided on a polyester film with the surface smoothening layer shown in Example 12 to a dried film thickness of 10 μm. The image bearing belt had a pencil hardness similar to that of Example 12.

The image forming steps by use of said belt were constituted similarly as shown in FIG. 1, but the magnetic latent image was formed by inputting a pattern signal of bar cord type into the magnetic head equipped before the developing station A in place of laser scanner. Also, in the developing device shown in FIG. 2, the fixed magnetic roll included within the rotary sleeve was not capable of magnetizing the developing portion. This was intended for not disturbing the magnetic latent image. The toner image prepared by means of this device had a contrast which could sufficiently be read with an OCR head. The extinguishing step was performed by thermally quenching the back face of the image bearing belt. In this constitution, the image bearing belt gave constantly stable OCR reading signals in repetitive formation of images.

We claim:

1. An image forming method using an image bearing member having a photoconductive layer and having a maximum surface roughness of 20 μm or less and an average surface roughness satisfying a relation of $r \leqq 2d$; wherein r is an average surface roughness of the surface, and d is a mean particle size of the toner particle, and having (i) a contact angle with water of at least 70 degrees, and (ii) a pencil hardness of at least F as measured according to the JIS test method K-5400, which comprises a repetitive cycle of steps comprising exposing an optical image on an image bearing member from the side of the substrate, and forming a toner image on the front surface of the image bearing member corresponding to the portion where said optical image exposure is applied.

2. An image forming method according to claim 1, wherein a surface layer containing a white pigment or dye is formed on said photoconductive layer.

3. An image forming method according to claim 1, wherein said toner image is further exhibited as a display.

4. An image forming method according to claim 1, wherein a toner image is formed simultaneously with said optical image exposure.

5. An image forming method using an image bearing member having a maximum surface roughness of 20 μm or less and an average surface roughness satisfying a relation of $r \leqq 2d$; wherein r is an average surface roughness of the surface; and d is a mean particle size of the toner particles, and having (i) a contact angle with water of at least 70 degrees, and (ii) a pencil hardness of at least F as measured according to the JIS test method K-5400, which comprises a repetitive cycle of steps comprising forming the toner image on the surface, exhibiting said toner image as a display, and extinguishing said toner image.

6. An image forming method according to claim 5, wherein said image bearing member has a conductive layer and a photoconductive layer or a dielectric layer for the surface for forming a toner image on the synthetic resin sheet or film.

7. An image forming method according to claim 5, wherein said image bearing member comprises successively a conductive layer, a photoconductive layer or a dielectric layer and a surface layer for forming a toner image, on the synthetic resin sheet or film.

* * * * *

UNITED STATES PATENT AND TRADEMARK OFFICE

CERTIFICATE OF CORRECTION

PATENT NO. : 4,693,951

DATED : September 15, 1987

INVENTOR(S) : YOSHIO TAKASU, ET AL.

It is certified that error appears in the above-identified patent and that said Letters Patent is hereby corrected as shown below:

TITLE PAGE

Foreign Application Priority Data should be inserted as follows:
--[30] Foreign Application Priority Data
Jun. 9, 1983 [JP] Japan . . . . . 58-103171
Jun. 9, 1983 [JP] Japan . . . . . 58-103172
Jun. 9, 1983 [JP] Japan . . . . . 58-103173

AT [56] REFERENCES CITED

"Amaya" should read --Amaya et al.--.

AT [57] ABSTRACT

Line 8, "at" should read --of at--.
Line 11, "image" should read --an image--.

COLUMN 1

Line 36, "vidual" should read --visual--.
Line 40, "method," should read --method--.
Line 47, "of image" should read --of an image--.

COLUMN 2

Line 32, "to be changed greatly" should read --which can greatly change--.
Line 33, "quality More" should read --quality. More--.

UNITED STATES PATENT AND TRADEMARK OFFICE

CERTIFICATE OF CORRECTION

PATENT NO. : 4,693,951

DATED : September 15, 1987

INVENTOR(S) : YOSHIO TAKASU, ET AL.

It is certified that error appears in the above-identified patent and that said Letters Patent is hereby corrected as shown below:

COLUMN 3

Lines 14-15, "to provide" should read --provided--.
Line 22, "at" should read --of at--.
Line 48, "improveent" should read --improvement--.

COLUMN 4

Line 3, "degree" should read --degrees--.
Line 37, "tnsile" should read --tensile--.
Line 45, "of" should read --of a--.
Lines 54-55, "in the way" should read --on the way--.
Line 60, "being" should be deleted.

COLUMN 5

Line 7, "half" should read --half of the--.
Line 38, "I a" should read --a--.

COLUMN 7

Lines 23-24, "polycrabonate" should read --polycarbonate--.

COLUMN 8

Lines 40-41, "densiometer" should read --densitomer--.
Line 44, "B versus" should read --B shows the density change versus--.
Line 53, "prepar" should read --prepare--.
Line 64, "about repetitive use for" should read --repetitive use for about--.

UNITED STATES PATENT AND TRADEMARK OFFICE

CERTIFICATE OF CORRECTION

PATENT NO. : 4,693,951

DATED : September 15, 1987

INVENTOR(S) : YOSHIO TAKASU, ET AL.

It is certified that error appears in the above-identified patent and that said Letters Patent is hereby corrected as shown below:

COLUMN 9

Line 31, "claims" should read --the claims--.
Line 62, "mumidity" should read --humidity--.

COLUMN 10

Line 18, "claims" should read --the claims--.

COLUMN 11

Line 2, "kinds" should read --kinds of image bearing surfaces--.
Line 8, "bearing" should read --bearing member--.
Line 9, "claims" should read --the claims--.
Line 28, "of" should read --of the--.

COLUMN 12

Line 32, "relfec-" should read --reflec---.

COLUMN 13

Line 4, "roll" should read --roller--.
Lines 40-41, "solution. ¶ The" should read --solution. The--.

UNITED STATES PATENT AND TRADEMARK OFFICE

CERTIFICATE OF CORRECTION

PATENT NO. : 4,693,951

DATED : September 15, 1987

INVENTOR(S) : YOSHIO TAKASU, ET AL.

It is certified that error appears in the above-identified patent and that said Letters Patent is hereby corrected as shown below:

COLUMN 14

Lines 41-42, "in ¶ Example 6," should read --in Example 6,--.
Line 54, "degree." should read --degrees.--.
Line 55, "underiably" should read --undesirably--.

COLUMN 15

Line 3, "roll" should read --roller--.
Line 35, "Kasci" should read --Kasei--.

COLUMN 17

Line 58, "roll" should read --roller--.

UNITED STATES PATENT AND TRADEMARK OFFICE

CERTIFICATE OF CORRECTION

PATENT NO. : 4,693,951

DATED : September 15, 1987

INVENTOR(S) : YOSHIO TAKASU, ET AL.

It is certified that error appears in the above-identified patent and that said Letters Patent is hereby corrected as shown below:

COLUMN 18

Table 4, "Generation" should read --Generation--.

| | |
|---|---|
| of black streak | of black streak |
| 0.13 | do |
| 0.16 | do |

Signed and Sealed this

Twenty-ninth Day of March, 1988

*Attest:*

DONALD J. QUIGG

*Attesting Officer*

*Commissioner of Patents and Trademarks*